US007347795B2

(12) United States Patent
Yamagishi et al.

(10) Patent No.: US 7,347,795 B2
(45) Date of Patent: Mar. 25, 2008

(54) GOLF CLUB HEAD

(75) Inventors: Hisashi Yamagishi, Tokyo (JP); Yasunori Imamoto, Tokyo (JP)

(73) Assignee: Bridgestone Sports Co., Ltd., Tokyo (JP)

( * ) Notice: Subject to any disclaimer, the term of this patent is extended or adjusted under 35 U.S.C. 154(b) by 141 days.

(21) Appl. No.: 10/868,363

(22) Filed: Jun. 16, 2004

(65) Prior Publication Data

US 2005/0020382 A1 Jan. 27, 2005

(30) Foreign Application Priority Data

Jun. 18, 2003 (JP) ..... P2003-173667

(51) Int. Cl.
*A63B 53/04* (2006.01)

(52) U.S. Cl. ..... 473/345; 473/347; 473/349

(58) Field of Classification Search ..... 473/324–350, 473/290–292

See application file for complete search history.

(56) References Cited

U.S. PATENT DOCUMENTS

| | | | | |
|---|---|---|---|---|
| 3,652,094 | A | 3/1972 | Glover | |
| 4,021,047 | A | 5/1977 | Mader | |
| 4,432,549 | A | 2/1984 | Zebelean | |
| 4,438,931 | A | 3/1984 | Motomiya | |
| 5,205,560 | A | 4/1993 | Hoshi et al. | |
| 5,255,913 | A | 10/1993 | Tsuchida | |
| 5,547,427 | A | 8/1996 | Rigal et al. | |
| 5,570,886 | A | 11/1996 | Rigal et al. | |
| 5,624,331 | A | 4/1997 | Lo et al. | |
| 5,669,827 | A | 9/1997 | Nagamoto | |
| 5,766,095 | A | 6/1998 | Antonious | |
| 5,967,904 | A * | 10/1999 | Nagai et al. | 473/345 |
| 5,997,415 | A | 12/1999 | Wood | |
| 6,010,411 | A | 1/2000 | Reyes | |
| 6,089,992 | A | 7/2000 | Onuki et al. | |
| 6,162,130 | A | 12/2000 | Masumoto et al. | |
| 6,248,025 | B1 | 6/2001 | Murphy et al. | |
| 6,254,494 | B1 | 7/2001 | Hasabe et al. | |
| 6,332,847 | B2 * | 12/2001 | Murphy et al. | 473/324 |
| 6,340,337 | B2 * | 1/2002 | Hasebe et al. | 473/349 |

(Continued)

FOREIGN PATENT DOCUMENTS

JP 5-68725 A 3/1993

(Continued)

OTHER PUBLICATIONS

U.S. Appl. No. 10/462,673, filed Jun. 17, 2003, Imamoto et al.*

(Continued)

*Primary Examiner*—Sebastiano Passaniti
(74) *Attorney, Agent, or Firm*—Sughrue Mion, PLLC

(57) ABSTRACT

A golf club head includes a front body formed of a titanium-based metal material, an FRP body, a metallic sole plate, and a weight member. The front body has a face portion, a metal sole portion, a metal side portion (toe), a metal crown portion, a metal side portion (heel), and a hosel portion. A slight gap is formed between a front side of the sole plate and the metal sole portion. Preferably, the front body is made of a titanium alloy, while the sole plate is made of stainless steel. The height of center of gravity (mm) and the head volume V have a relationship of $H \leqq 0.05V+7.5$.

15 Claims, 4 Drawing Sheets

U.S. PATENT DOCUMENTS

| | | | | |
|---|---|---|---|---|
| 6,354,962 | B1 | 3/2002 | Galloway et al. | |
| 6,354,963 | B1 | 3/2002 | Kodama et al. | |
| 6,371,868 | B1 | 4/2002 | Galloway et al. | |
| 6,381,828 | B1 | 5/2002 | Boyce et al. | |
| 6,406,378 | B1 | 6/2002 | Murphy et al. | |
| 6,435,977 | B1 | 8/2002 | Helmstetter et al. | |
| 6,435,978 | B1 | 8/2002 | Galloway et al. | |
| 6,440,008 | B2 | 8/2002 | Murphy et al. | |
| 6,440,011 | B1 | 8/2002 | Hocknell et al. | |
| 6,471,604 | B2 | 10/2002 | Hocknell et al. | |
| 6,491,592 | B2 | 12/2002 | Cackett et al. | |
| 6,524,194 | B2 | 2/2003 | McCabe | |
| 6,524,198 | B2 | 2/2003 | Takeda | |
| 6,527,650 | B2 | 3/2003 | Reyes et al. | |
| 6,575,845 | B2 | 6/2003 | Galloway et al. | |
| 6,582,321 | B2 | 6/2003 | Galloway et al. | |
| 6,582,323 | B2 | 6/2003 | Soracco et al. | |
| 6,602,149 | B1 | 8/2003 | Jacobson | |
| 6,607,452 | B2 | 8/2003 | Helmstetter et al. | |
| 6,620,056 | B2 | 9/2003 | Galloway et al. | |
| 6,623,378 | B2 | 9/2003 | Beach et al. | |
| 6,648,774 | B1 | 11/2003 | Lee | |
| 6,676,536 | B1 | 1/2004 | Jacobson | |
| 6,739,982 | B2 | 5/2004 | Murphy et al. | |
| 6,739,984 | B1 * | 5/2004 | Ciasullo | 473/345 |
| 6,872,152 | B2 | 3/2005 | Beach et al. | |
| 6,945,876 | B2 | 9/2005 | Nakahara et al. | |
| 7,128,661 | B2 * | 10/2006 | Soracco et al. | 473/329 |
| 2001/0049310 | A1 | 12/2001 | Cheng et al. | |
| 2002/0160858 | A1 | 10/2002 | Lee | |
| 2003/0083151 | A1 | 5/2003 | Nakahara et al. | |
| 2003/0125127 | A1 | 7/2003 | Nakahara et al. | |
| 2003/0134692 | A1 | 7/2003 | Nakahara et al. | |
| 2003/0134693 | A1 | 7/2003 | Nakahara et al. | |
| 2003/0186760 | A1 * | 10/2003 | Lee | 473/342 |
| 2003/0220155 | A1 * | 11/2003 | Nishitani | 473/335 |
| 2004/0005936 | A1 | 1/2004 | Imamoto et al. | |
| 2004/0116208 | A1 | 6/2004 | Deshiell et al. | |
| 2004/0266551 | A1 | 12/2004 | Noguchi et al. | |
| 2005/0043115 | A1 * | 2/2005 | Lin | 473/345 |
| 2006/0063608 | A1 | 3/2006 | Mori et al. | |

FOREIGN PATENT DOCUMENTS

| | | | |
|---|---|---|---|
| JP | 6-39941 | A | 2/1994 |
| JP | 07-112041 | A | 5/1995 |
| JP | 07-112042 | A | 5/1995 |
| JP | 7-155410 | A | 6/1995 |
| JP | 8-24377 | A | 1/1996 |
| JP | 9-38250 | A | 2/1997 |
| JP | 09-187534 | A | 7/1997 |
| JP | 9-215786 | A | 8/1997 |
| JP | 09-322953 | A | 12/1997 |
| JP | 10-15119 | A | 1/1998 |
| JP | 2000-033133 | A | 2/2000 |
| JP | 2001-340499 | A | 12/2001 |
| JP | 2002-011122 | A | 1/2002 |
| JP | 2002-224249 | A | 8/2002 |
| JP | 2003-62130 | A | 3/2003 |
| JP | 2003-144590 | A | 5/2003 |
| JP | 2003-205055 | A | 7/2003 |
| JP | 2003-320060 | A | 11/2003 |
| JP | 2004-016654 | A | 1/2004 |
| JP | 2004-065810 | A | 3/2004 |
| JP | 2004-180759 | | 7/2004 |
| WO | WO 2004/052472 | A1 | 6/2004 |

OTHER PUBLICATIONS

U.S. Appl. No. 11/094,355, filed Mar. 31, 2005, Ezaki et al.*
U.S. Appl. No. 11/240,364, filed Oct. 3, 2005, Imamoto et al.*
U.S. Appl. No. 11/097,254, filed Apr. 4, 2005, Ezaki et al.*
U.S. Appl. No. 11/252,801, filed Oct. 19, 2005, Imamoto et al.*
U.S. Appl. No. 11/233,143, filed Sep. 23, 2005, Imamoto et al.*

* cited by examiner

GOLF CLUB HEAD

BACKGROUND OF THE INVENTION

1. Field of the Invention

The present invention relates to a hollow golf club head, and particularly to a golf club head being of a wood type or similar type thereto.

2. Description of the Related Art

As wood-type golf club heads such as drivers and fairway woods, metallic heads of a hollow shell structure are widely in use. Generally, the hollow wood-type golf club head has a face portion for hitting a ball, a crown portion constituting an upper surface portion of the golf club head, a sole portion constituting a bottom surface portion of the golf club head, a side portion constituting side surface portions on the toe side, the rear side, and the heel side of the golf club head, and a hosel portion. A shaft is inserted into the hosel portion, and is fixed by an adhesive agent or the like. It should be noted that golf clubs called utility clubs are also commercially available on the market in large numbers, and various golf clubs having a head similar to the aforementioned wood-type golf club head (i.e., having the face portion, the sole portion, the side portion, the crown portion, and the hosel portion) are also commercially available on the market.

As metals for forming this hollow golf club head, an aluminum alloy, stainless steel, and a titanium alloy are used. The titanium alloy, in particular, has come to be used widely in recent years.

Generally, it becomes possible to enlarge the sweet spot by increasing the volume of the hollow golf club head. If the volume is increased, the weight of the golf club head tends to increase correspondingly. Accordingly, to prevent an increase in the weight, it has been conceived to adopt a fiber reinforced resin whose specific gravity is smaller than those metals.

JP-A-2001-340499 discloses a golf club head in which the face portion and the sole portion are made of a metal, and the other portions including the crown portion and the side portions on the toe side and the heel side are formed of a carbon-fiber reinforced thermosetting resin (CFRP). With this golf club head, however, the seam between a peripheral edge of the face portion, on the one hand, and the crown portion and the side portion formed of CFRP, on the other hand, is in an abutted state. During ball hitting an extremely large stress occurs in this seam between the peripheral edge of the face portion and the crown portion and the side portion. If the golf club head is used repeatedly, this joint portion is likely to peel off.

JP-A-2003-62130 discloses a golf club head in which a front edge portion of the crown, a front edge portion of the sole, and both side front edge portions are forged of titanium integrally with the face portion to be a face element, a body formed of a resin material is joined to this titanium-made face element continuously therewith, and an aluminum plate is disposed on the sole portion. Since this face element includes the front edge portion of the crown, the front edge portion of the sole, and the both side front edge portions, it may be possible that the bonding strength between the face element and the resin-made body can be made greater than that of the seam between the CFRP-made crown portion and the metallic face portion in JP-A-2001-340499 mentioned above.

SUMMARY OF THE INVENTION

The invention provides a golf club head whose height of center of gravity is appropriate.

According to one embodiment of the invention, a golf club head of a hollow shell structure includes a first member that includes titanium-based metal material and includes a face portion and an edge portion continuous with the face portion. Volume of the golf club head and height of center of gravity of the golf club head have a relation of $H \leqq 0.05V + 7.5$ where V denotes volume of the golf club head in cc unit, and H denotes height of center of gravity of the golf club head in mm unit.

With the above-described golf club head, since the center of gravity is low, the launch angle of the ball becomes high.

To lower the height of center of gravity, it is preferable to fix a metal plate to a sole portion, and it is preferable to provide a weight member in this metal plate. Further, portions other than the first member and the metal plate are preferably made of a fiber reinforced resin for the sake of the light weight.

In the golf club head of the invention, the weight of the first member is preferably in a range of 20% to 60% of the weight of the golf club head. As the remaining weight other than the weight of the first member is allotted to the metal plate and the weight member fixed to a rear portion of the metal plate, the position of the center of gravity of the golf club head can be made low, or can be moved to the rear side, making it possible to effect a design, as desired.

The invention is suitable for application to a large-size driver head whose weight needs to be suppressed to 180 g to 240 g, although its volume is large in a range of 300 cc to 470 cc.

In the invention, in a case where the volume of the golf club head is 300 cc to 350 cc, the height of center of gravity H is preferably 20 mm to 23.5 mm. In a case where the volume of the golf club head is 350 cc to 400 cc, the height of center of gravity H is preferably 20 mm to 25.5 mm. In a case where the volume of the golf club head is 400 cc to 470 cc, the height of center of gravity H is preferably 20 mm to 28 mm.

DETAILED DESCRIPTION OF THE PREFERRED EMBODIMENTS

Figure 1:
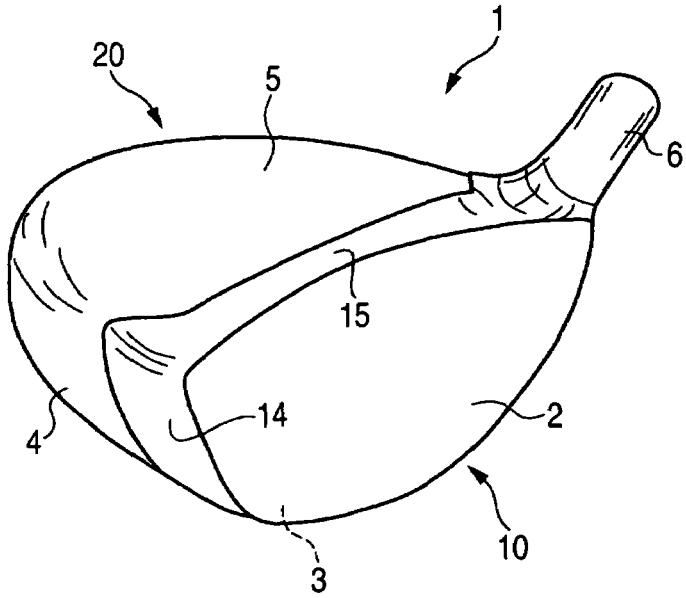
FIG. 1 is a perspective view of a golf club head in accordance with the embodiment.
Figure 2:
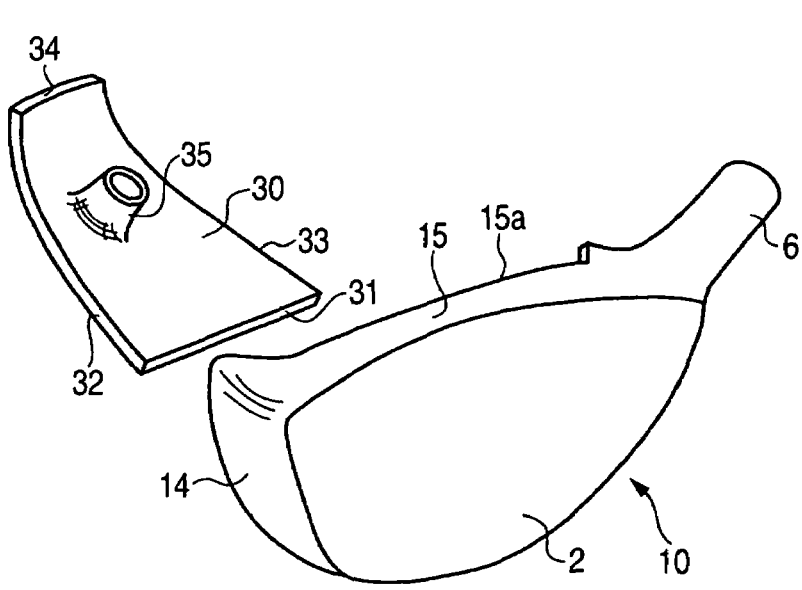
FIG. 2 is a perspective view, as taken from the front side, of a front body and a sole plate of this golf club head.
Figure 3:
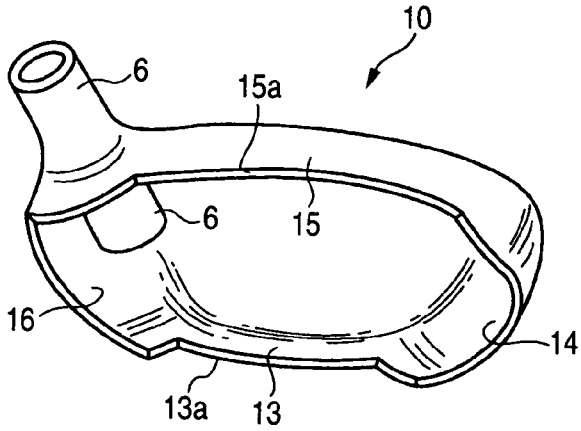
FIG. 3 is a perspective view, as taken from the rear side, of the front body.
Figure 4A:
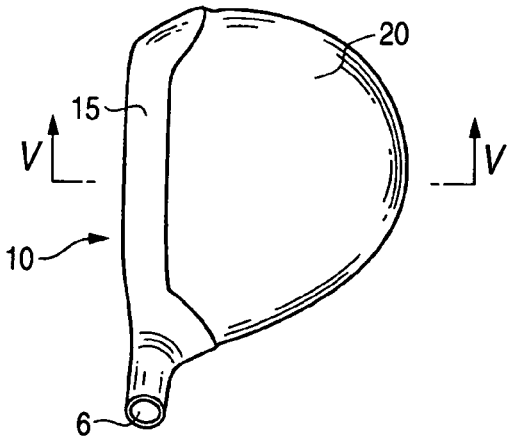
FIG. 4A is a plan view of this golf club head.
Figure 4B:
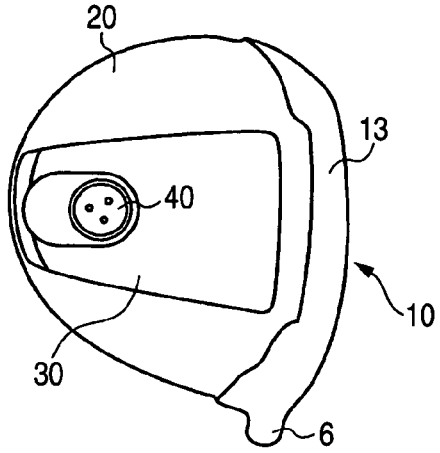
FIG. 4B is a bottom view of this golf club head.
Figure 5A:
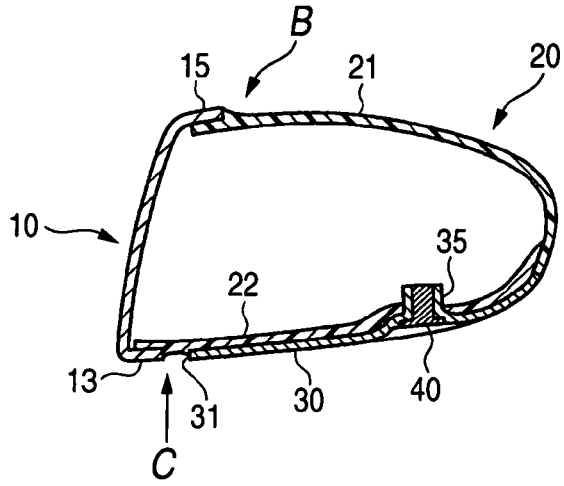
FIG. 5A is a section view taken along line V-V in FIG. 4A.
Figure 5B:
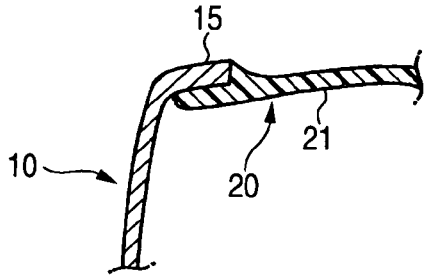
FIGS. 5B and 5C are enlarged views of a portion B and a portion C in FIG. 5A.
Figure 5C:
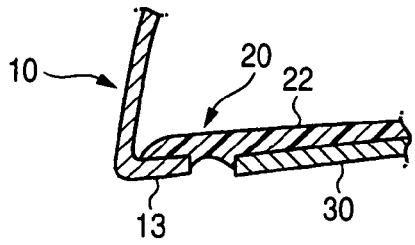
Figure 6:
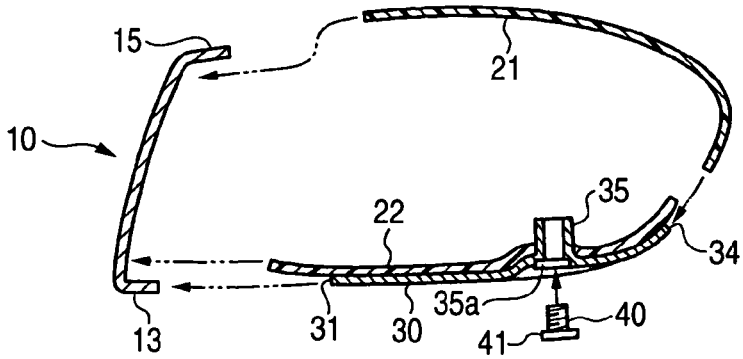
FIG. 6 is a section view illustrating a method of manufacturing this golf club head.

Hereafter, a description will be given on an embodiment of the invention with reference to the drawings. FIG. 1 is a perspective view of a golf club head in accordance with the embodiment. FIG. 2 is a perspective view of a front body and a sole plate of this golf club head as viewed from a front side. FIG. 3 is a perspective view of the front body as viewed from a rear side. FIG. 4A is a plan view of this golf club head. FIG. 4B is a bottom view of this golf club head. FIG. 5A is a section view taken along line V-V in FIG. 4A. FIGS. 5B and 5C are enlarged views of a portion B and a portion C in FIG. 5A. FIG. 6 is a section view illustrating a method of manufacturing this golf club head. FIGS. 7A to 7E are explanatory diagrams of prepreg sheets used in the manufacture of an FRP body of this golf club head.

This golf club head 1 is a wood-type golf club head of a hollow shell structure including a face portion 2, a sole portion 3, a side portion 4, a crown portion 5, and a hosel portion 6.

The face portion 2 is a surface for hitting a ball, and is provided with grooves (scoring lines), which are not shown. The sole portion 3 constitutes a bottom portion of the golf club head. The side portion 4 constitutes side surface portions on the toe side, the heel side, and the rear surface side. The crown portion 5 constitutes an upper surface portion of the golf club head. A shaft is inserted into the hosel portion 6, and is secured by means of an adhesive agent.

This golf club head 1 includes a front body 10 formed of a titanium-based metal material (a titanium alloy or pure titanium), a fiber reinforced resin body (hereafter referred to as the FRP body) 20, a metallic sole plate 30, and a weight member 40. The weight of this front body 10 is in a range of 20% to 70%, preferably 30% to 60%, of the total weight of the golf club head.

As clearly shown in FIGS. 2 and 3, the front body 10 includes the face portion 2, a metal sole portion 13, a metal side portion (toe) 14, a metal crown portion 15, a metal side portion (heel) 16, and the hosel portion 6.

The metal sole portion 13 constitutes a front edge portion of the sole portion 3. The metal side portions 14 and 16 constitute front edge portions of the side portion 4. The metal crown portion 15 constitutes a front edge portion of the crown portion 5. The metal crown portion 15 is continuous with the metal side portion (toe) 14 and the metal side portion (heel) 16. The metal side portion (toe) 14 and the metal side portion (heel) 16 are respectively continuous with the metal sole portion 13. The metal side portions 14 and 16 and the metal sole portion 13 are continuous with the face portion 2.

As for the metal sole portion 13 and the metal crown portion 15, widths in the forward and rearward direction (widths in a direction perpendicular to the face portion 2) are large on the toe side and the heel side, and their widths in the forward and rearward direction in the remaining central portions 13*a* and 15*a* are small. As a result, the moment of inertia of the golf club head can be made large. It should be noted that these widths in the forward and rearward direction are made gradually smaller from the toe side and the heel side toward the central portions 13*a* and 15*a*.

The length in the toe-heel direction of the center portions 13*a* and 15*a* having small widths in the forward and rearward direction is preferably 50%-85% of the maximum width of the front body 10 in the crown portion, and is preferably 55%-80% of the maximum width of the front body 10 in the sole portion.

The width, in the forward and rearward direction, of the central portion 15*a* of the metal crown portion 15 is preferably 50%-95%, particularly 55%-70% of the maximum width of the front body 10 in the forward and rearward direction, while the width of the central portion 13*a* of the metal sole portion 13 in the forward and rearward direction is preferably 50%-95%, particularly 50%-65% of the maximum width of the front body 10 in the forward and rearward direction.

This front body 10 is preferably formed integrally by forging or casting, in particular. It should be noted that, in the case of forging, the hosel portion is formed by machining. However, the front body can also be constructed by joining a plurality of separately formed portions by welding or the like.

A gap of 4 mm to 12 mm, particularly 7 mm to 9 mm is formed on an average between a front side 31 of the sole plate 30 and the metal sole portion 13, as clearly shown in FIGS. 5A and 5C. The FRP body 20 is interposed between these two members. A rear side 34 of the sole plate 30 is located in proximity to a rearmost portion of the golf club head 1, but is located slightly forwardly of the rearmost end of the golf club head 1.

The sole plate 30 is disposed in a whole area in the vicinity of the central portion, in the toe-heel direction, of the metal sole portion 13. As shown in FIG. 2, this sole plate 30 has a substantially quadrangular shape having the front side 31 facing the metal sole portion 13, sides 32 and 33 extending in the rearward direction from both ends of the front side 31, and the rear side 34. The front side 31 is longer than the rear side 34, and the sides 32 and 33 approach each other toward their rear sides. Accordingly, the sole plate 30 is substantially trapezoidal in a plan view shape. The sole plate 30 is curved in conformity with the sole surface of the golf club head 1.

The length of the front side 31 of the sole plate 30 is preferably 50%-75%, particularly 60%-75% of the length in the toe-heel direction of the central portion 13*a* of the metal sole portion 13. The length of the rear side 34 is preferably 50%-80%, particularly 55%-75% of the length of that front side 31.

The width of the sole plate 30 in the forward and rearward direction is preferably 65%-90%, particularly 75%-85% of the maximum length of the golf club head 1 in the forward and rearward direction.

This sole plate 30 is formed of a metal material such as stainless steel, aluminum, a copper alloy, a titanium alloy, or the like.

A cylindrical portion 35 protrudes in a rear portion of this sole plate 30 toward the interior of the golf club head 1. The weight member 40 is secured in an inner hole of the cylindrical portion 35 by screwing-in.

The weight member 40 is formed with a flange portion 41 on a lower end thereof. The cylindrical portion 35 is formed with a stepped portion 35*a* for receiving the flange portion 41 at a lower edge thereof.

The sole plate 30 is slightly depressed around the periphery of the cylindrical portion 35.

The weight member 40 is formed of a metal whose specific gravity is greater than that of the sole plate 30, such as tungsten or a tungsten alloy. The specific weight of the weight member 40 is preferably 10 or more, particularly in a range of 10 to 13. The central position of the weight member 40 is located on a rear portion side of a center of the golf club head 1 in the forward and rearward direction.

The golf club head 1 has the following relationship in the height of center of gravity H (mm) and the volume V:

$$H \leqq 0.05V+7.5$$

It is noted that herein below, the value of 0.05V+7.5 is referred to as a Q value.

Next, a description will be given on a method for manufacturing the golf club head according to the embodiment of the invention.

To manufacture this golf club head 1, the metallic front body 10, the sole plate 30, and a plurality of prepreg sheets are used.

Figure 7A:
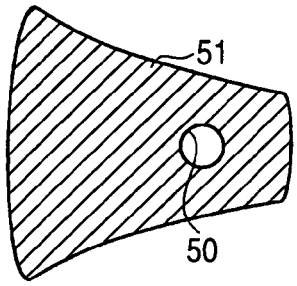
FIGS. 7A to 7E are explanatory diagrams of prepreg sheets used in the manufacture of an FRP body of this golf club head.
Figure 7B:
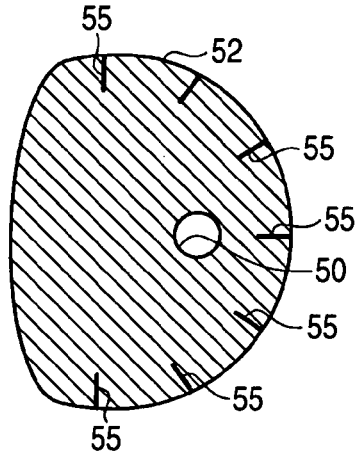
Figure 7C:
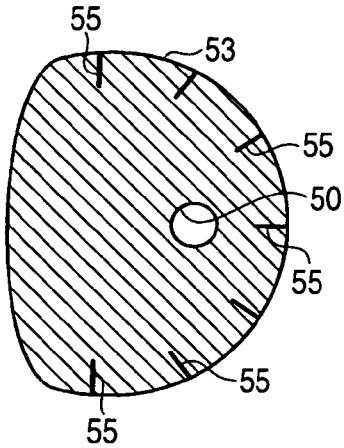
Figure 7D:
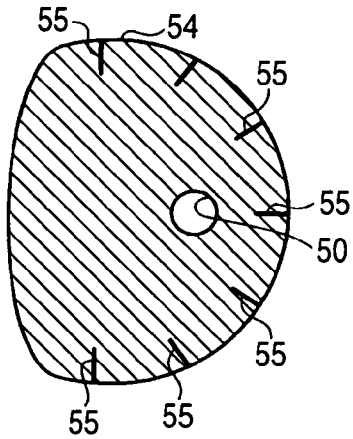
Figure 7E:
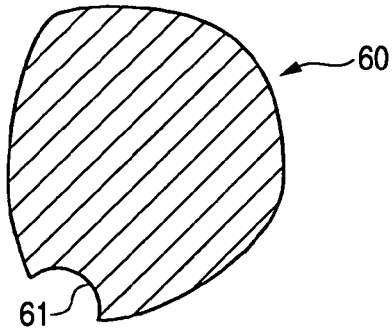

FIGS. 7A to 7E are plan views illustrating the prepreg sheets adopted in this embodiment. A prepreg sheet 51 shown in FIG. 7A is one in which a carbon fiber cloth is impregnated with a thermosetting synthetic resin. Prepreg sheets 52, 53, 54, and 60 shown in FIGS. 7B, 7C, 7D, and 7E are those in which carbon fibers are oriented in one direction and are impregnated with the thermosetting synthetic resin. The prepreg sheets 51 to 54 constitute the lower half side of the FRP body 20, and are respectively provided with circular openings 50 for allowing the cylindrical portion 35 of the sole plate 30 to pass therethrough.

The prepreg sheet 51 is directly superposed on the sole plate 30, and has a substantially trapezoidal shape, which is slightly larger than the sole plate 30.

The prepreg sheets 52, 53, and 54 are directly superposed on the prepreg sheet 51 in that order. In order to constitute the lower half of the FRP body 20, each of these prepreg sheets 52 to 54 has such a size that the lower half of the FRP body 20 is developed. A plurality of slits 55 are cut in both sides and rear edges of these prepreg sheets 52 to 54 at predetermined intervals, so that the sides and the rear edges of the prepreg sheets 52 to 54 are easily curved along the inner surface of a molding die.

In the case of the prepreg sheet 52, the carbon fibers are oriented in the toe-heel direction. In the case of the prepreg sheet 53, the carbon fibers are oriented obliquely to the toe-heel direction 60° clockwise. In the case of the prepreg sheet 54, the carbon fibers are oriented obliquely to the toe-heel direction 60° counterclockwise.

The prepreg sheet 60 is used for constituting the upper surface side of the FRP body 20 and is formed with a substantially semicircular notched portion 61, with which the hosel portion 6 engages.

In manufacturing of the golf club head 1, the sole plate 30 is first fitted in the die having a cavity surface conforming to the sole and sides. The prepreg sheets 51 to 54 are superposed in that order. Then, these prepreg sheets 51 to 54 are semihardened on heating for a short time, so as to be formed into the shape of a sole portion 22 of the FRP body 20 and to be integrated with the sole plate 30, as shown in FIG. 6.

The prepreg sheet 60 is also fitted in the die having a cavity surface conforming to the crown portion, and is semihardened on heating for a short time, so as to be formed into the shape of a crown portion 21 of the FRP body 20, as shown in FIG. 6.

Subsequently, the prepreg sheet 60 and the prepreg sheets 51 to 54 with the sole plate are fitted in the molding die (not shown) for golf club head 1.

At this time, the front edge of the crown portion 21 formed of the prepreg sheet 60 is superposed on the lower surface of the metal crown portion 15 (inner side surface of the head). In addition, the front edge of the sole portion 22 formed of the prepreg sheets 51 to 54 is superposed on the upper surface of the metal sole portion 13 (inner side surface of the head). It should be noted that the front edge of the sole portion 22 projects forwardly of the front side 34 of the sole plate 30, and the rear edge of the sole portion 22 projects rearwardly of the rear side 34 of the sole plate 30, as shown in FIG. 6. The rear edge of the crown portion 21 is superposed on the outer surface of the rear edge of this sole portion 22.

Next, the molding die is heated, and gas pressure of air or the like is introduced into the molding die through the cylindrical portion 35. This causes the crown portion 21 and the sole portion 22 formed of the semihardened prepreg sheets to be pressed against the inner surface of the molding die, the prepreg sheets to become fully hardened, the crown portion 21 and the sole portion 22 to be secured to the front body 10, and the crown portion 21 and the sole portion 22 to be joined together.

Subsequently, the molded piece is released, the weight member 40 is threadedly secured to the cylindrical portion 35, and finishing such as deburring and coating is performed to form the product gold club head 1.

With the golf club head thus constructed, the front body 10, the FRP body 20, the sole plate 30, and the weight member 40 are combined, so that the designing of its center of gravity is facilitated.

In this embodiment, since all the portions continuous with the front body 10, including a portion between the front body 10 and the sole plate 30, are formed of FRP, the head can be easily flexed and provided with high repulsion during ball hitting. In particular, in this embodiment, since the crown portion of the FRP body 20 is easily flexed, the hitting-out angle can be made large, and the flight distance can be increased.

EXAMPLE 1

In the embodiment illustrated in the drawings, the front body 10 was made of a titanium alloy with a weight of 100 g, the sole plate 30 was made of stainless steel with a weight of 34 g, and the weight member 40 was made of a tungsten alloy with a weight of 24 g, thereby fabricating the golf club head 1 with a volume of 370 cc and a total weight of 198 g. The fabricated golf club head 1 had 21 mm in the height of center of gravity and 0.86 in coefficient of restitution.

It is noted that, in Example 1, $Q=0.05V+7.5=0.05\times370+7.5=26$ mm.

EXAMPLE 2

In Example 1, the weight of the front body was set to 90 g, the weight of the weight member was set to 23 g, the head weight was set to 190 g, and the head volume was set to 390 cc. The height of center of gravity was 22 mm, and the coefficient of restitution was 0.87. It is noted that, in this Example 2, $Q=0.05V+7.5=0.05\times390+7.5=27$ mm.

COMPARATIVE EXAMPLE 1

A golf club head with a volume of 350 cc was fabricated from CFRP, and a brass-made weight member of 10 g was fixed to it, thereby manufacturing a golf club head of 180 g. The height of center of gravity was 26 mm, the Q value was 25 mm, and the coefficient of restitution was 0.82.

COMPARATIVE EXAMPLE 2

A golf club head of 360 cc and 160 g, the entire body of which was made of a titanium alloy, was fabricated. The weight member was similarly made of a tungsten alloy of 10 g. The height of center of gravity was 26 mm, the Q value was 25.5 mm, and the coefficient of restitution was 0.85. This golf club head was low in durability.

COMPARATIVE EXAMPLE 3

In Example 1, the head volume was set to 375 cc, the weight of the front body was set to 150 g, the sole plate was omitted, and a tungsten alloy weight member of 20 g was fixed to the head. The height of center of gravity was 31 mm, the Q value was 26.25 mm, and the coefficient of restitution was 0.8.

As described above, in accordance with the invention, it is possible to provide a golf club head whose height of center of gravity is appropriate.

What is claimed is:

1. A golf club head of a hollow shell structure, comprising:

a first member that includes titanium-based metal material and includes a face portion and an edge portion continuous with the face portion, and a metal plate that is separate and spaced apart from the first member, extends in a direction, which is different from a toe-heel direction of the golf club head, and includes at least a part of sole portion;

wherein:

$$H \leqq 0.05V+7.5$$

where V denotes volume of the golf club head in cc unit, and H denotes height of center of gravity of the golf club head in mm unit;

wherein the metal plate is made of a metal material, which is larger in specific gravity than the titanium-based metal material; and wherein a gap of 4 mm to 12 mm is formed between a front side of the metal plate and the first member.

2. The golf club head according to claim 1, wherein the height of the center of gravity is in a range of 20 mm to 28 mm.

3. The golf club head according to claim 1, further comprising:

a second member formed of a fiber reinforced resin.

4. The golf club head according to claim 3, wherein the second member directly abuts an inside surface of the first member around a periphery of the club head, and wherein edges of the first and second members are in contact along a crown portion of the first and second members.

5. The golf club head according to claim 1, wherein weight of the first member is in a range of 20% to 60% of weight of the golf club head.

6. The golf club head according to claim 1, wherein a hosel portion is integrally formed with the face portion.

7. The golf club head according to claim 1, further comprising:

a weight member that is fixed to the metal plate.

8. The golf club head according to claim 7, wherein the metal plate comprises a cylindrical portion having a threaded inner hole, and the weight member is threadedly secured to the inner hole.

9. The golf club head according to claim 1, wherein:

volume of the golf club head is in a range of 300 cc to 470 cc; and weight of the golf club head is in a range of 180 g to 240 g.

10. The golf club head according to claim 9, wherein:

the volume of the golf club head is in a range of 300 cc to 350 cc; and the height of the center of gravity is in a range of 20 mm to 23.5 mm.

11. The golf club head according to claim 9, wherein:

the volume of the golf club head is in a range of 350 cc to 400 cc; and the height of the center of gravity is in a range of 20 mm to 25.5 mm.

12. The golf club head according to claim 9, wherein:

the volume of the golf club head is in a range of 400 cc to 470 cc; and the height of the center of gravity is in a range of 20 mm to 28 mm.

13. The golf club head according to claim 1, wherein the gap is 7 mm to 9 mm.

14. A golf club head of a hollow shell structure, comprising:

a first member that includes titanium-based metal material and includes a face portion and an edge portion continuous with the face portion, a metal plate that is separate and spaced apart from the first member, extends in a direction, which is different from a toe-heel direction of the golf club head, and includes at least a part of sole portion; and a weight member that is fixed to the metal plate;

wherein:

$$H \leqq 0.05V+7.5$$

where V denotes volume of the golf club head in cc unit, and H denotes height of center of gravity of the golf club head in mm unit;

wherein the metal plate is made of a metal material, which is larger in specific gravity than the titanium-based metal material;

wherein the metal plate comprises a cylindrical portion having a threaded inner hole, and the weight member is threadedly secured to the inner hole; and wherein the weight member comprises a flange portion on a lower end thereof, and the cylindrical portion of the metal plate comprises a stepped portion for receiving the flange portion at a lower edge thereof.

15. The golf club head according to claim 14, wherein the metal plate is slightly depressed around the periphery of the inner hole.

* * * * *